US007449100B2

(12) United States Patent
Yoshimura et al.

(10) Patent No.: US 7,449,100 B2
(45) Date of Patent: Nov. 11, 2008

(54) METHOD FOR FORMING ELECTROPLATING FILM ON SURFACES OF ARTICLES

(75) Inventors: Kohshi Yoshimura, Osaka (JP); Fumiaki Kikui, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 508 days.

(21) Appl. No.: 10/467,349

(22) PCT Filed: Oct. 25, 2002

(86) PCT No.: PCT/JP02/11096

§ 371 (c)(1),
(2), (4) Date: Aug. 20, 2003

(87) PCT Pub. No.: WO03/038157

PCT Pub. Date: May 8, 2003

(65) Prior Publication Data

US 2004/0069650 A1 Apr. 15, 2004

(30) Foreign Application Priority Data

| | | |
|---|---|---|
| Oct. 29, 2001 | (JP) | 2001-330806 |
| Jan. 25, 2002 | (JP) | 2002-017686 |
| Feb. 28, 2002 | (JP) | 2002-052834 |
| Jul. 29, 2002 | (JP) | 2002-220425 |

(51) Int. Cl.
*C23C 28/02* (2006.01)

(52) U.S. Cl. ..... 205/184; 205/187

(58) Field of Classification Search ..... 205/184, 205/187

See application file for complete search history.

(56) References Cited

U.S. PATENT DOCUMENTS

| | | | | |
|---|---|---|---|---|
| 3,522,094 | A * | 7/1970 | Richman | 429/42 |
| 3,775,176 | A | 11/1973 | Cross et al. | 117/227 |
| 4,470,883 | A | 9/1984 | Eichelberger et al. | 205/15 |
| 5,302,464 | A * | 4/1994 | Nomura et al. | 428/551 |
| 6,819,211 | B2 | 11/2004 | Yoshimura et al. | 335/302 |

FOREIGN PATENT DOCUMENTS

| | | | |
|---|---|---|---|
| DE | 30 40 784 | A1 | 5/1982 |
| EP | 0 502 475 | A2 | 9/1992 |
| EP | 1 024 506 | A1 | 8/2000 |
| EP | 1 028 437 | A1 | 8/2000 |
| GB | 1149033 | | 4/1969 |
| GB | 2169925 | | 7/1986 |
| GB | 2169925 | A * | 7/1986 |
| JP | 44-27478 | | 11/1969 |
| JP | 61-130453 | | 6/1986 |
| JP | 4-276095 | | 10/1992 |
| JP | 5-82320 | | 4/1993 |
| JP | 7-161516 | | 6/1995 |
| JP | 7-176443 | | 7/1995 |
| JP | 8-186016 | | 7/1996 |
| JP | 9-205013 | | 8/1997 |
| JP | 11-260614 | | 9/1999 |
| JP | 2000-91112 | | 3/2000 |
| JP | 2000-133541 | | 5/2000 |
| JP | 2001-6909 | | 1/2001 |
| JP | 2001-189205 | | 7/2001 |
| JP | 2001-295091 | | 10/2001 |
| WO | 83/02538 | A1 | 7/1983 |
| WO | WO 8302538 | A1 * | 7/1983 |
| WO | 87/04190 | | 7/1987 |
| WO | WO 99/23675 | | 5/1999 |

OTHER PUBLICATIONS

Chinese Office Action w/English translation dated Mar. 11, 2005.
Supplementary European Search Report issued on Apr. 3, 2007 for European patent application No. 02 77 7953.
Japanese Office Action mailed on Jan. 29, 2008.

* cited by examiner

*Primary Examiner*—Edna Wong
(74) *Attorney, Agent, or Firm*—Kratz, Quintos & Hanson, LLP

(57) ABSTRACT

An object of the present invention is to provide a method for forming a uniform and dense electroplating film with high adhesion strength on the surface of an article, yet irrespective of the surface material and the surface properties of the article. A means for a solution of the problem comprises: forming on the surface of the article, a resin coating made of a resin containing dispersed therein a powder of a first metal; then forming a second-metal substituted plating film on the surface of the resin coating by immersing the resin-coated article in a solution containing ions of a second metal having an ionization potential nobler than that of the first metal; and further forming an electroplating film of a third metal on the surface of the metal-substituted plating film.

9 Claims, No Drawings

METHOD FOR FORMING ELECTROPLATING FILM ON SURFACES OF ARTICLES

TECHNICAL FIELD

The present invention relates to a method for forming a uniform and dense electroplating film with high adhesion strength on the surface of an article, yet irrespective of the surface material and the surface properties of the article.

BACKGROUND ART

In order to impart properties such as decorative properties, anti-weathering properties, surface conductivity for antistatic purposes and the like, electromagnetic shielding properties, antibiotic functions, and shock resistance, to articles, metallic films have been formed on the surface of the articles heretofore. Metallic films can be formed by various methods; among them, methods for forming electroplating films by means of electroplating processes are widely employed in practice because they are also suitable for mass production.

However, in order to form electroplating films on the surface of articles, it is required that the surface of the articles possesses electric conductivity. Hence, electroplating films cannot be directly formed on the surface of an article made of a non-conductive material such as plastics, wood, papers, glass, ceramics, rubbers, and concrete. Furthermore, there are cases in which metallic films are required to be formed on the surface of an article made of a metallic material such as magnesium, aluminum, and titanium, (e.g., housings of cellular phones, laptop personal computers, etc.), however, for example, magnesium is one of the most base metals. Thus, in case an attempt is made to form an electroplating film on the surface of such an article, an abrupt substitution plating reaction occurs at the instant of immersing the article in the plating bath, and this makes the formation of high quality electroplating films unfeasible. Aluminum and titanium are metals that are easily oxidized, and in general, the surface of such metals is covered with extremely dense metal oxide films. Accordingly, although these metals are lower in ionization tendency, the surface potential is elevated to make an electroplating treatment difficult. While it is possible to form electroplating films by removing the metal oxide films from the surface, a special etching technology is needed, and there still remain practical problems due to time constraints, because an electroplating process should be carried out before the metal oxide film is formed again after removing the metal oxide films. Furthermore, there may be employed a method of performing an electroplating process comprising, carrying out the so-called zincate treatment for forming a zinc substituted plating film, while simultaneously applying etching, under a strong alkaline environment by immersing the article in a solution containing sodium hydroxide and zinc hydroxide, and then carrying out the step of forming an electroless plating film, and then carrying out the electroplating process. However, this makes the entire process complicated.

Furthermore, in case of forming a uniform electroplating film on the surface of an article having pores, fine grooves, or irregularities on the surface thereof, such as wooden bats, bricks, die-castings, and the like, there remain problems to be solved; considerations should be made on not only how to impart electric conductivity to the surface of the article, but also how to ensure surface smoothness of the article.

Moreover, a corrosion of an article may occur on carrying out an electroplating process in case of an article made of a highly corrosive material such as metallic magnesium; hence, difficulties are found on forming electroplating films on such articles.

In case of solving the above problems by means of known technologies, there may be employed a method as disclosed in Japanese Patent Laid-Open No. 210183/1986, comprising forming, on the surface of the article, a resin coating made of a resin containing dispersed therein a metallic powder, and then forming an electroless plating film on the surface of the resin coating; an electroplating film can be formed on the thus formed surface of the electroless plating film. However, since an electroless plating film is formed by reacting reducing agents to metallic ions in the plating solution and obtaining metal precipitates as a consequence on the surface of plated articles, not only the adhesiveness to the plated object, but also the film deposition efficiency are poor. Although the film deposition efficiency can be increased by methods using palladium catalysts or platinum catalysts, these methods inevitably increase costs. Furthermore, there is no denying that impurities contained in an electroless plating film and originated from the reducing agents provide negative influences on the formation of electroplating films on the surface of the electroless plating film.

Accordingly, an object of the invention is to provide a method for forming a uniform and dense electroplating film with high adhesion strength on the surface of an article, yet irrespective of the surface material and the surface properties of the article.

DISCLOSURE OF THE INVENTION

In the light of the aforementioned circumstances, the present inventors accomplished the invention as a result of extensive studies; thus, a first method for forming an electroplating film on the surface of an article according to the present invention comprises: forming on the surface of the article, a resin coating made of a resin containing dispersed therein a powder of a first metal; then forming a second-metal substituted plating film on the surface of the resin coating by immersing the resin-coated article in a solution containing ions of a second metal having an ionization potential nobler than that of the first metal; and further forming an electroplating film of a third metal on the surface of the metal-substituted plating film.

In accordance with a second formation method, there is disclosed the first method, wherein the resin coating is a non-conductive coating.

According to a third formation method, there is disclosed the second method, wherein the article is a rare earth permanent magnet.

Furthermore, according to a fourth formation method, there is disclosed the third method, wherein the rare earth permanent magnet is a bonded magnet.

According to a fifth formation method, there is disclosed the second method, wherein the volume resistivity of the non-conductive coating is $1\times10^4$ Ω·cm or higher.

In accordance with a sixth formation method, there is disclosed the first method, wherein the powder of the first metal is dispersed in the resin coating at a content in a range of from 50 wt % to 99 wt %.

According to a seventh formation method, there is disclosed the first method, wherein the average particle diameter of the powder of the first metal is in a range of from 0.001 μm to 30 μm.

In accordance with an eighth formation method, there is disclosed the first method, wherein the film thickness of the resin coating is in a range of from 1 μm to 100 μm.

According to a ninth formation method, there is disclosed the first method, wherein the first metal is zinc and the second metal is nickel or tin.

According to a tenth formation method, there is disclosed the first method, wherein the first metal is nickel and the second metal is copper.

According to an eleventh formation method, there is disclosed the first method, wherein the second metal and the third metal are the same.

According to a twelfth formation method, there is disclosed the eleventh method, wherein the step of forming the substituted plating film and the step of forming the electroplating film are carried out in the same plating bath.

In accordance with a thirteenth formation method, there is disclosed the first method, wherein the film thickness of the substituted plating film is in a range of from 0.05 μm to 2 μm.

An article according to the invention is characterized by having an electroplating film formed on the surface thereof by the method for forming an electroplating film as recited in the first method.

A method for forming a substituted plating film on the surface of an article according to the invention is characterized by that it comprises: forming on the surface of the article, a resin coating made of a resin containing dispersed therein a powder of a first metal, and then forming a second-metal substituted plating film on the surface of the resin coating by immersing the resin-coated article in a solution containing ions of a second metal having an ionization potential nobler than that of the first metal.

An article according to the invention is characterized by having a substituted plating film formed on the surface thereof by the method for forming a substituted plating film as recited directly above.

A rare earth permanent magnet having an electroplating film on the surface thereof according to the invention is characterized by produced by forming a non-conductive coating on the surface of a rare earth permanent magnet using a resin containing dispersed therein a powder of a first metal; then forming a second-metal substituted plating film on the surface of the non-conductive coating by immersing the magnet having formed thereon the non-conductive coating in a solution containing ions of a second metal having an ionization potential nobler than that of the first metal; and further forming an electroplating film of a third metal on the surface of the metal-substituted plating film.

A rare earth permanent magnet having an electroplating film on the surface thereof according to the invention is characterized by that it comprises, formed on the surface of a rare earth permanent magnet, a non-conductive coating made of a resin containing dispersed therein a powder of a first metal, and having further thereon an electroplating film of a third metal, with a substituted plating film of a second metal that is nobler than the first metal interposed between them.

A rare earth permanent magnet having a substituted plating film on the surface thereof according to the invention is characterized by that it comprises, formed on the surface of a rare earth permanent magnet, a non-conductive coating made of a resin containing dispersed therein a powder of a first metal, and having further thereon a substituted plating film of a second metal that is nobler than the first metal.

A rare earth permanent magnet having a non-conductive coating on the surface thereof according to the invention is characterized by that it comprises, formed on the surface of a rare earth permanent magnet, a non-conductive coating made of a resin containing dispersed therein a powder of a first metal.

BEST MODE FOR CARRYING OUT THE INVENTION

The method for forming an electroplating film on the surface of an article according to the invention is characterized by that it comprises: forming on the surface of the article, a resin coating made of a resin containing dispersed therein a powder of a first metal; then forming a second-metal substituted plating film on the surface of the resin coating by immersing the resin-coated article in a solution containing ions of a second metal having an ionization potential nobler than that of the first metal; and further forming an electroplating film of a third metal on the surface of the metal-substituted plating film.

In the method for forming an electroplating film on the surface of an article according to the invention, a resin coating made of a resin containing dispersed therein a powder of a first metal is formed on the surface of an article, and then, a second-metal substituted plating film having high adhesion strength is formed on the entire surface of the resin coating by utilizing a substitution plating reaction which is initiated from the powder of the first metal that is present on the surface of the resin coating or in the vicinity thereof. In this manner, as a result, electric conductivity is imparted to the entire surface of the article, and a uniform and dense electroplating film of the third metal can be formed with high adhesion strength on the surface of the substituted plating film. Accordingly, a uniform and dense electroplating film can be formed with high adhesion strength on the surface of the article made of any type of material, such as plastics, wood, papers, glass, ceramics, rubbers, and concrete, yet irrespective of the surface material and the surface properties of the article.

The method for forming an electroplating film on the surface of an article according to the invention is explained step by step below.

Step 1:

Firstly, a resin coating made of a resin containing dispersed therein a powder of a first metal is formed on the surface of an article. As the resin for use as the base of the resin coating, there can be mentioned, for example, a thermosetting resin. More specifically, there can be mentioned, for instance, phenolic resin, epoxy resin, melamine resin, acrylic resin, polyester resin, urethane resin, polyimide resin, styrene-acrylic resin, and mixed resins thereof.

There is no particular limitation concerning the kinds of the powder of the first metal to be dispersed in the resin coating, however, in order to initiate the substitution plating reaction in the later step, it is essential that the potential of the first metal is lower than that of the second metal. Accordingly, the first metal should be properly selected by taking the potential difference between the first and the second metals into consideration. As a specific example of the combination of the first and the second metals, there can be mentioned a combination using zinc as the first metal and nickel or tin as the second metal, or a combination using nickel as the first metal and copper as the second metal.

The resin coating made of a resin containing dispersed therein the powder of the first metal may be an electrically conductive coating or a non-conductive coating, however, a non-conductive coating is preferred for a resin coating that is formed on the surface of an article made of a highly corrosive material such as metallic magnesium, or for a resin coating that is formed on the surface of a highly corrosive rare earth permanent magnet, which is to be stated hereinafter. Even in case the surface of the resin coating should be corroded on carrying out a substituted plating process or an electroplating process, or in case the surface of the resin coating should be corroded through the defects such as pinholes, and flaws, which are generated in the electroplating films formed on the substituted plating film provided on the surface of the resin coating, further progress of the corrosion through the interior of the resin coating to the surface of the article can be prevented from occurring.

Rare earth permanent magnets such as R—Fe—B based permanent magnets, which are represented by a Nd—Fe—B based permanent magnet, are now utilized in various fields because of their high magnetic properties, and because of their allowing use of low cost materials abundant in resources.

Recently, in the electronic industries and in the electric appliance industries where rare earth permanent magnets are used, more compact components are used and further down sizing is under way. Accordingly, more compact magnets or magnets with more complicated shapes are demanded.

From this point of view, bonded magnets based mainly on magnetic powder and resin binders, which are easily tailored into desired shapes, are attracting attention, and are brought into practical use in various fields.

Rare earth permanent magnets contain R (rare earth element), which is easily oxidized and corroded in air. Thus, in case they are used without applying surface treatment, the corrosion proceeds from the surface due to the effect of acids, alkalis, water, and the like that are slightly present in air, and rust generates as a result. This causes deterioration or fluctuation in magnetic properties. Moreover, in case magnets having rust generated thereon are assembled in devices such as magnetic circuits, it is feared that rust is scattered to contaminate peripheral components.

In order to overcome the problems above, attempts are made to form electroplating films on the surface of magnets as anticorrosive films. However, in case an attempt is made to form the electroplating film directly on the surface of the bonded magnet, a uniform and dense film is unfeasible, because the magnetic powder constituting the surface of the magnet, which is insulated by the resin binder, or the resin part interposed among such magnetic powder has low conductivity. As a result, pinholes (non-plated parts) generate to induce rust generation.

In the light of such circumstances, as a method of forming an electroplating film after imparting electric conductivity to the entire surface of the bonded magnet, there is proposed, for instance, in Japanese Patent No. 2719658 (Japanese Patent Laid-Open No. 276095/1992), a method comprising coating the surface of the bonded magnet with a mixture of a resin and a powder of an electrically conductive material to form an electrically conductive resin coating, and then applying electroplating. However, when viewed microscopically, this method fails to impart sufficiently high electric conductivity to the entire surface of the resin. Thus, it is impossible to completely eliminate parts of low electric conductivity from the surface. As a result, there occurs a problem that a uniform and dense electroplating film cannot be formed. Further problem is that, since the resin coating formed on the surface of the magnet is electrically conductive, if the surface of the resin coating should be corroded at the time of carrying out the electroplating process and the like, the corrosion proceeds through the electrically conductive part of the interior of the coating to the surface of the magnet.

The patent above also proposes a method comprising carrying out the electroplating process after applying electroless plating to the surface of the bonded magnet. According to this method, however, water that is used as the solvent for the processing solution or various components contained in the processing solution remain in the pores and the like of the magnet when an electroless plating or the like is applied, and these occasionally cause the corrosion of the magnet, as to make the adhesiveness of the film thus obtained to the surface of the magnet yet insufficient.

Accordingly, it can be understood that satisfactory results are not yet achieved by the methods proposed heretofore, and novel methods for forming electroplating films on the surface of bonded magnets are keenly demanded. The present invention enables the formation of a uniform and dense electroplating film with high adhesion strength on the surface of bonded magnets, and by providing resin coating on the surface of the bonded magnet as a non-conductive coating, an excellent corrosion resistance can be imparted to the bonded magnet.

The non-conductive coating made of a resin containing dispersed therein a powder of a first metal can be obtained, for instance, by spray-coating the surface of the article with the non-conductive resin itself, in which the powder of the first metal is dispersed, or, if necessary, with a processing solution prepared by diluting the resin with an organic solvent, or, by performing immersion coating, in which the article is immersed in the processing solution and then by drying them. Such a non-conductive resin containing dispersed therein the metallic powder are easily obtained, since some of them are commercially available. Furthermore, an electrically conductive resin dispersed therein a powder of a first metal may be rendered a non-conductive processing solution by adding organic dispersants, such that the metallic powder is uniformly dispersed and isolated. In such a case, preferable organic dispersants for use from the viewpoint of affinity with the metallic powder and cost are, for example, anionic dispersants (e.g., aliphatic polycarboxylic acids, polyether polyester carboxylates, high molecular polyester acid polyamine salts, high molecular weight polycarboxylic acid long chain amine salts, and the like), nonionic dispersants (e.g., polyoxyethylene alkyl ether, carboxylic acid salts such as sorbitan ester, sulfonic acid salts, ammonium salts, and the like), high molecular dispersants (e.g., carboxylic acid salts, sulfonic acid salts, ammonium salts of water-soluble epoxy and the like, styrene-acrylic acid copolymer, glue, and the like). Furthermore, so long as the processing solution is capable of forming non-conductive coatings, the solution itself may be electrically conductive. On preparing the processing solution, a disperser such as a ball mill, an attritor, and a sand mill, may be used properly.

In order to form a substituted plating film on the entire surface of the resin coating by initiating the substitution plating reaction from the metallic powder contained in the resin coating, the metallic powder should be present uniformly and abundantly on the surface of the resin coating or in the vicinity thereof. From this point of view, the processing solution is preferably prepared as such that the metallic powder should be dispersed in the resin coating at an amount of 50 wt % or more. The upper limit of the amount of the metallic powder dispersion in the resin coating is not limited, however, in general, it is difficult to prepare a processing solution for forming a resin coating containing dispersed therein the metallic powder at a concentration exceeding 99 wt % (since there occurs problems such as the coagulation and settling of the metallic powder in the processing solution, or the difficulty in handling due to an increase in viscosity of the processing solution). Accordingly, from the viewpoint of the production, the upper limit of the amount of the metallic powder dispersion in the resin coating is 99 wt %.

In order to prepare a processing solution containing uniformly dispersed therein the metallic powder, the average particle diameter of the metallic powder is preferably in a range of from 0.001 μm to 30 μm, more preferably, from 0.01 μm to 12 μm, and further preferably, from 2 μm to 10 μm.

In case the resin coating made of the resin containing dispersed therein the powder of the first metal thus formed is non-conductive, the non-conductive coating prevents corrosion from proceeding deeply through the interior of the coating to reach the surface of the article, even in case the surface of the coating is corroded. Thus, the resin coating exerts an effect of imparting corrosion resistance to the article. It is believed that the self-repairing function (i.e., by generating corrosion compounds of the first metal (in case the first metal is zinc, the compounds are, for example, $ZnCl_2.4Zn(OH)_2$, and ZnO,), or by swelling the resin and thereby increasing the volume of the resin coating, such that the coating itself should exhibit function of burying defects, such as pinholes and flaws) of the coating, as well as the sacrificial anticorrosion function of the first metal, contributes to the aforementioned effect. In order to further ensure this effect, the volume resistivity of the non-conductive coating is preferably set to $1\times10^4$ Ω·cm or higher. The organic dispersant above may be added to the processing solution as to suppress the coagulation and settling of the metallic powder from occurring in the processing solution, thereby improving the dispersibility of the metallic powder and increasing the volume resistivity. In case the article is a rare earth permanent magnet, the magnet having provided with a non-conductive coating of high volume resistivity on the surface thereof produces less eddy current in the magnet when assembled in a motor. This is a valuable effect in the point that the loss in motor efficiency is suppressed because thermal demagnetization due to the heat generated by eddy current is reduced. The value is further enhanced in case such magnets are assembled inside the motor in a multiply laminated structure.

In order to sufficiently exhibit the effect above, and to form a uniform substituted plating film on the entire surface of the resin coating by rendering a smooth surface to the resin coating and providing the metallic powder uniformly and abundantly on the surface of the resin coating and in the vicinity thereof, the resin coating is preferably provided at a film thickness in a range of from 1 μm to 100 μm. However, in case the film thickness of the resin coating is increased, there may be cases in which the resin coating unfavorably influences the formation of a uniform electroplating film. In case the article is a rare earth permanent magnet, accordingly, by taking the point above and the effective volume of the magnet into consideration, the upper limit of the film thickness of the resin coating is preferably 30 μm.

Furthermore, in order to improve the adhesiveness of the surface of the article with the resin coating at the interface, known cleaning methods such as degreasing of the surface of the article or barrel polishing for imparting anchoring effect may be performed prior to the process for forming the resin coating made of the resin containing dispersed the rein the powder of the first metal.

Step 2:

Then, a second-metal substituted plating film is formed on the surface of the resin coating by immersing the resin-coated article obtained in step 1 in a solution containing ions of a second metal having an ionization potential nobler than that of the first metal. The second-metal substituted plating film not only has the function of imparting electric conductivity to the entire surface of the article, but also contributes to improve the surface cleanliness of the article by preventing dropping out of the first metallic powder particles from occurring on the resin coating. This step can be carried out in accordance with an ordinary method for forming a substituted plating film, however, from the viewpoint of assuring sufficiently high conductivity for forming a uniform and dense electroplating film of the third metal in the later processes, it is preferred to form a film having a film thickness of 0.05 μm or thicker. Prior to forming the substituted plating film, in order to obtain a smooth surface on the resin coating and to expose an active surface of the powder of the first metal uniformly dispersed in the resin coating, barrel polishing may be applied to the article having a resin coating formed on the surface thereof. The upper limit of the film thickness of the substituted plating film is not particularly limited, however, in view of production cost, the film thickness is preferably set to 2 μm or less. To achieve the object of imparting decorative properties, surface conductivity for antistatic purposes, and the like, to articles, the product obtained at this step with substituted plating film formed on the surface thereof sufficiently fulfills the effect at a practically satisfactory level.

Step 3:

Finally, an electroplating film of the third metal is formed on the surface of the substituted plating film obtained in step 2. This step can be carried out in accordance with a known method for forming an electroplating film. As described above, the combination of the first and the second metals must be selected by taking the difference in potential of the metals into consideration; however, there is no particular constraints concerning the relation between the third and the second metals, and usable as the third metal are those generally used for electroplating films, such as Ni, Cu, Sn, Co, Zn, Cr, Ag, Au, Pb and Pt. Accordingly, the same metal may be used as the second and the third metals without any problem.

In case the same metal is used for the second and the third metals, that is, in case the metal constituting the substituted plating film is used for the electroplating film, a single plating bath can be conveniently employed for both step 2 for forming the substituted plating film and step 3 for forming the electroplating film. More specifically, for example, at the instance the article having the resin coating made of the resin containing dispersed therein the powder of the first metal on the surface thereof is immersed in the plating bath, a substituted plating film is formed by allowing a substitution plating reaction to proceed without applying any voltage, and then, the electroplating film can be formed by applying voltage. Furthermore, even in case voltage is applied at the instance the article having the resin coating made of the resin containing dispersed therein the powder of the first metal on the surface thereof is immersed in the plating bath, a substituted plating film is formed on the surface of the resin coating at first by the substitution plating reaction that occurs according to the potential difference between the first and the second metals, because the volume resistivity of the resin coating is high at the initial stage of immersion. Thus, as a result, electric conductivity is imparted to the entire surface of the article as to form a uniform and dense electroplating film on the surface of the substituted plating film. The film thickness of the electroplating film can be properly set according to purposes. However, from the viewpoint of assuring the effective volume of the magnet while imparting excellent corrosion resistance in case the article is a rare earth permanent magnet, it is preferred that the electroplating film is formed at a film thickness in a range of from 10 μm to 30 μm.

For instance, in case of forming a Ni substituted plating film and a Ni electroplating film on the surface of a rare earth bonded magnet by using a single plating bath, various types of plating baths may be used depending on the shape of the magnet. As the plating bath, there can be used known plating baths such as Watt's bath, sulfamic acid bath, and Wood's bath. In order to form a Ni substituted plating film with high adhesion strength on the surface of a non-conductive coating made of a resin containing dispersed therein the powder of the first metal, for instance, a low-nickel high-sulfate bath is preferably used to suppress excessive conversion efficiency (film formation rate of a Ni substituted plating film) between the first metal and nickel. As a preferred low-nickel high-sulfate bath, there can be mentioned a plating bath containing 100 g/L to 170 g/L of nickel sulfate pentahydrate, 160 g/L to 270 g/L of sodium sulfate, 8 g/L to 18 g/L of ammonium chloride, and 13 g/L to 23 g/L of boric acid. The pH value of the plating bath is preferably set in a range of from 4.0 to 8.0. In case pH is lower than 4.0, there is fear of causing negative influences on rare earth bonded magnets that are unstable under acidic conditions; in case pH exceeds 8.0, on the other hand, it is feared that the adhesion strength of the thus generated Ni substituted plating film results low. Furthermore, by setting the pH of the plating bath in a range of from 4.0 to 8.0, it can also achieve the object of effectively suppressing the negative influences on the adhesion strength to the Ni electroplating film which is formed on the surface of a Ni substituted plating film, when a coarse and rough Ni substituted plating film is formed, due to an abrupt elution of the first metal having a potential lower than Ni. The bath temperature of the plating bath is preferably set in a range of from 30° C. to 70° C. In case the temperature is lower than 30° C., the Ni substituted plating film may result in a coarse and rough surface; on the other hand, in case the temperature exceeds 70° C., temperature control of the bath becomes difficult as to make the formation of a uniform Ni substituted plating film unfeasible. On forming a Ni electroplating film after forming the Ni substituted plating film by using the plating bath above, the electric current density is preferably set in a range of from 0.2 A/dm$^2$ to 20 A/dm$^2$. In case the current density is lower than 0.2 A/dm$^2$, the film deposition rate becomes too low to result in an inferior productivity; on the other hand, in case the current density exceeds 20 A/dm$^2$, numerous pinholes may form due to the coarsening and roughening of the surface of the Ni electroplating film. An electrolytic Ni plate is used as the anode, and a nickel tip containing S is preferably used as the electrolytic Ni plate to stabilize Ni elution.

In case of forming an Sn substituted plating film and an Sn electroplating film on the surface of a rare earth bonded magnet by using a single plating bath, for instance, various types of plating baths may be used depending on the shape of the magnet. The pH value of the plating bath is preferably set in a range of from 3.5 to 9.0. In case pH is lower than 3.5, there is fear of causing negative influences on rare earth bonded magnets that are unstable under acidic conditions; in case pH exceeds 9.0, on the other hand, it is feared that the adhesion strength of the thus generated Sn substituted plating film results low. The bath temperature of the plating bath is preferably set in a range of from 15° C. to 35° C. In case the temperature is lower than 15° C., the Sn substituted plating film may result in a coarse and rough surface; on the other hand, in case the temperature exceeds 35° C., temperature control of the bath becomes difficult as to make the formation of a uniform Sn substituted plating film unfeasible. On forming an Sn electroplating film after forming the Sn substituted plating film by using the plating bath above, the electric current density is preferably set in a range of from 0.1 A/dm$^2$ to 5.0 A/dm$^2$. In case the current density is lower than 0.1 A/dm$^2$, the film deposition rate becomes too low to result in an inferior productivity; on the other hand, in case the current density exceeds 5.0 A/dm$^2$, numerous pinholes may form due to the coarsening and roughening of the surface of the Sn electroplating film.

Also, in case of forming a Cu substituted plating film and a Cu electroplating film on the surface of a rare earth bonded magnet by using a single plating bath, for instance, various types of plating baths may be used depending on the shape of the magnet. The pH value of the plating bath is preferably set in a range of from 5.0 to 8.5. In case pH is lower than 5.0, there is fear of causing negative influences on rare earth bonded magnets that are unstable under acidic conditions; in case pH exceeds 8.5, on the other hand, it is feared that the adhesion strength of the thus generated Cu substituted plating film results low. The bath temperature of the plating bath is preferably set in a range of from 25° C. to 70° C. In case the temperature is lower than 25° C., the Cu substituted plating film may result in a coarse and rough surface; on the other hand, in case the temperature exceeds 70° C., temperature control of the bath becomes difficult as to make the formation of a uniform Cu substituted plating film unfeasible. On forming a Cu electroplating film after forming the Cu substituted plating film by using the plating bath above, the electric current density is preferably set in a range of from 0.1 A/dm$^2$ to 5.0 A/dm$^2$. In case the current density is lower than 0.1 A/dm$^2$, the film deposition rate becomes too low to result in an inferior productivity; on the other hand, in case the current density exceeds 5.0 A/dm$^2$, numerous pinholes may form due to the coarsening and roughening of the surface of the Cu electroplating film. As the plating bath, it is preferred to use a neutral Cu plating bath that is less corrosive and intrusive to rare earth bonded magnets, and particularly preferred is a neutral Cu-EDTA bath containing copper sulfate, ethylenediamine tetraacetic acid, and sodium sulfite as the principal components.

In case of forming an electroplating film on the surface of ring-shaped bonded magnets by using the method of the invention, there may occur a case in which protrusions are locally generated on the inner surface of the magnet. This phenomenon is found to occur in case the hardness of the resin for use as the base of the non-conductive coating made of the resin containing dispersed therein the powder of the first metal is low. Accordingly, to avoid this phenomenon from occurring, the resin for use as the base of the non-conductive coating is preferably high in hardness; more specifically, it is preferred to use resins capable of yielding Rockwell hardness of M80 or higher when cured, such as, phenolic resin (M110), epoxy resin (M80), acrylic resin (M80), polyester resin (M80), and polyimide resin (M128). Among them, particularly in the case of the heat resistant thermosetting resins represented by polyimide resin, i.e., the so-called super engineering plastics, those resins effectively function to prevent the degradation of the characteristics as a non-conductive coating from occurring, which degradation occurs due to the fact that the powder of the first metal being dispersed in the resin achieves bonding effect even in case the resin part undergoes softening due to heat and load that are applied to the magnet, as a result, the volume resistivity is lowered. That is, the resins above are more preferred from the viewpoint that they impart heat resistance to the non-conductive coating. In case of using plural resins in mixture, the resins are preferably combined such that the mixed resin yields Rockwell hardness of M80 or higher when cured. For instance, a mixed resin of epoxy resin and polyimide resin yields Rockwell hardness of M80 or higher when cured, and it not only shows excellent miscibility, but also yields excellent dispersibility of metallic powder. Hence, such mixed resin is preferred also from the viewpoint of excellent heat resistance. Furthermore, in order to avoid local generation of protrusions, the stress of the plating film formed as laminates on the surface of the non-conductive coating can be relaxed by adjusting the amount of addition of the brighteners, for instance, saccharin based brighteners such as aromatic sulfonamide and aromatic sulfonimide, as well as butynediol based brighteners such as 2-butyne-1,4-diol which are added in the plating bath for forming electroplating films.

Further, other electroplating films may be formed as laminates on the electroplating film formed above. By employing such a constitution, properties of the article such as corrosion resistance, and mechanical strength, can be reinforced or compensated, or additional function can be imparted to the article.

Among the rare earth permanent magnets as articles to which the invention is applied, bonded magnet may be a magnetically isotropic bonded magnet or a magnetically anisotropic bonded magnet so long as the bonded magnet contains magnetic powder and resin binders as the principal components. In addition to the magnets that are bonded and shaped by using a resin binder, those bonded and shaped by using a metallic binder or an inorganic binder are included in the bonded magnets above. Furthermore, the binder may contain fillers.

Rare earth bonded magnets differing in compositions and crystal structures are known, and the invention is applicable to all of these.

For instance, there can be mentioned an anisotropic R—Fe—B based bonded magnet disclosed in Japanese Patent Laid-Open No. 92515/1997, a Nd—Fe—B based nanocomposite magnet having a soft magnetic phase (e.g., $\alpha$-Fe and $Fe_3B$) and a hard magnetic phase ($Nd_2Fe_{14}B$) as disclosed in Japanese Patent Laid-Open No. 203714/1996, or a bonded magnet using an isotropic Nd—Fe—B based magnetic powder (e.g., MQP-B (trade name) produced by MQI corp.) prepared by a widely used conventional melt quenching process.

Further included are the R—Fe—N based bonded magnets expressed by $(Fe_{1-x}R_x)_{1-y}N_y$ ($0.07 \leqq x \leqq 0.3$, $0.001 \leqq y \leqq 0.2$)) as disclosed in Japanese Patent Publication No. 82041/1993.

The magnetic powder constituting the rare earth bonded magnet can be obtained by methods such as a dissolution and milling process which comprises melting a rare earth permanent magnet alloy, subjecting it to a casting treatment to produce an ingot, and pulverizing the ingot; a sintered-product pulverizing process which comprises producing a sintered magnet and then pulverizing the sintered magnet; a reduction and diffusion process which produces a magnetic powder directly by the Ca reduction; a rapid solidification process which comprises producing a ribbon foil of a rare earth permanent magnet alloy by a melting jet caster, and pulverizing and annealing the ribbon foil; an atomizing process which comprises melting a rare earth permanent magnet alloy, powdering the alloy by atomization and subjecting the powdered alloy to a heat treatment; and a mechanical alloying process which comprises powdering a starting metal, finely pulverizing the powdered metal and subjecting the finely pulverized metal to a heat treatment, and the like.

Furthermore, the magnetic powder constituting the R—Fe—N based bonded magnet may be obtained by a gas nitrided process, which comprises pulverizing a rare earth permanent magnet alloy, nitriding the pulverizing alloy in gaseous nitrogen or gaseous ammonia, and then finely pulverizing the resulting alloy.

The effect of the invention does not depend on the attributes of the magnetic powder constituting the rare earth permanent magnet, such as the composition, the crystal structure, whether it is anisotropic or not, and the like. Accordingly, the desired effect can be obtained whether the rare earth permanent magnet is a bonded magnet or a sintered magnet; however, the effect above is particularly advantageous for a bonded magnet.

In case the invention is applied to a laminated magnet obtained by laminating plural rare earth permanent magnets by using an adhesive such as anaerobic adhesive, an electroplating film can be formed on the entire surface of the laminated magnet inclusive of the adhesive part interposed to adhere the magnets with each other. Accordingly, the invention provides an adhesion degradation prevention effect, because the intrusion of substances degrading the adhesion (e.g., water) at the adhesion interface between the magnet and the adhesive can be inhibited.

Furthermore, ring-shaped rare earth bonded magnets are sometimes used under environments in which liquid fuel is present; for instance, they are sometimes assembled in motors of liquid feeding pumps for liquid fuels (e.g., gasoline, light oil, liquefied petroleum gas, and the like) that are mounted on automobiles and the like. In such a case, excellent durability against liquid fuel can be imparted to the ring-shaped rare earth bonded magnet by first forming, on the surface of the magnet, a non-conductive coating made of a resin containing dispersed therein the powder of the first metal, then forming a second-metal substituted plating film on the surface of the non-conductive coating by immersing the magnet coated with the non-conductive coating in a solution containing the ions of the second metal having an ionization potential nobler than that of the first metal, and by then forming an electroplating film of the third metal on the surface of the substituted plating film. In this case, mentioned as the third metal favorably used are nickel and tin, which exhibit high corrosion resistance against liquid fuels.

EXAMPLES

The invention is described in further detail below by referring to experiments below, but it should be understood that the invention is not limited thereby.

Experiment A (Formation of an Electroplating Film on the Surface of a Ring-Shaped Rare Earth Bonded Magnet)

The alloy powder consisting of particles having an average major axis diameter of 150 μm and containing 12% by atomic (at %) Nd, 77 at % Fe, 6 at % B, and 5 at % Co was prepared by a rapid solidification process, and was kneaded with epoxy resin added at a concentration of 2 wt %. The resulting mixture was compression molded under a pressure of 686 $N/mm^2$, followed by curing at 150° C. for 1 hour. Thus was obtained a ring-shaped bonded magnet (denoted hereinafter as "magnet test piece") 30 mm in outer diameter, 28 mm in inner diameter, and 4 mm in length, which was subjected to the following experiments.

Example 1

EPO ROVAL (trade name of a commercially available product of ROVAL Corporation; yields Rockwell hardness of M80 when cured, and is based on epoxy resin with a zinc powder having an average particle diameter of 4 μm) was used as a non-conductive resin containing dispersed therein a zinc powder, and was diluted with EPO Thinner (trade name of a commercially available product of ROVAL Corporation) at a weight ratio of 1:0.5 (EPO ROVAL:thinner). By uniformly stirring the resulting product, there was obtained a non-conductive resin solution containing dispersed therein a zinc powder. The solution thus obtained was used for spray coating the entire surface of the magnet test piece by operating an air spray apparatus equipped with a gun 1.5 mm in aperture diameter at a blowing pressure of 0.2 MPa. Thus, by drying at an ordinary temperature (20° C.) for 60 minutes and baking at 200° C. for 30 minutes, a non-conductive coating (having a volume resistivity of $3\times10^5$ Ω·cm as measured in accordance with JIS-H0505 standard method) containing 96 wt % of dispersed zinc powder was formed at a film thickness of 15 μm (as measured by observation of cross section) on the surface of the magnet test piece. Salt water spray test was conducted by spraying 5 wt % salt water at 35° C. on the thus obtained magnet test piece having thereon the non-conductive coating made of the resin containing the zinc powder dispersed therein. Even after a lapse of 500 hours, no magnet test piece showed change in outer appearance (n=50).

Twenty-five magnet test pieces having thereon the non-conductive coating made of the resin containing the zinc powder dispersed therein were fed into a 2.8 L volume barrel bath together with 2.0 L of alumina media each 4 mm in diameter, and barrel polishing was conducted for 30 minutes under conditions of 1.0 mm amplitude and 60 Hz frequency.

After subjecting the magnet test pieces having the non-conductive coating formed thereon to barrel polishing, they were subjected to ultrasonic rinsing with water for 3 minutes, and were immersed at 55° C. for 30 minutes without applying voltage in Watt's bath containing 240 g/L of nickel sulfate pentahydrate, 45 g/L of nickel chloride pentahydrate, and 35 g/L of boric acid, with pH being adjusted to 4.2 by using nickel carbonate, to thereby form a Ni substituted plating film on the surface of the non-conductive coating. At this instance, 5 out of 25 magnet test pieces were drawn out of Watt's bath to study the film thickness of the thus formed Ni substituted plating film. The average film thickness was found to be 1 μm (by observation using fluorescent X-ray spectroscopy).

The rest of the magnet test pieces (20 pieces) were subjected to a Ni electroplating process by applying voltage at a current density of 1.5 A/dm$^2$ for 90 minutes to form a Ni electroplating film on the surface of the Ni substituted plating film.

The magnet test pieces having a Ni electroplating film on the outermost surface thus obtained were subjected to ultrasonic rinsing with water for 3 minutes, and were dried at 100° C. for 60 minutes.

On observing the outer appearance of the Ni electroplating film formed on the outermost surface of the 20 magnet test pieces with a magnifying glass (at 4 times magnification), no defective products having pinholes, protrusions, adhesion of foreign matter, and the like were found, and all of them were evaluated to be fine products having uniform coating. The average (n=5) total thickness of the Ni plating film formed on the surface of the non-conductive coating was found to be 25 μm (by observation using fluorescent X-ray spectroscopy); hence, the average (n=5) film thickness of the Ni electroplating film was found to be 24 μm.

A corrosion resistance test was performed on 15 magnet test pieces having a Ni electroplating film formed on the outermost surface thereof, by allowing them to stand still under high temperature and high humidity conditions of 60° C. and 90% relative humidity for 500 hours. As a result, no abnormal appearance such as generation of rust, bulging of film, generation of local protrusion, and the like was observed on any of the magnet test pieces.

Comparative Example 1

A conductive resin solution containing dispersed therein a zinc powder was prepared by mixing and uniformly stirring 75 wt % of zinc powder consisting of particles 4 μm in average diameter, 22 wt % of xylene, and 3 wt % of EPOMIK (trade name of a commercially available product of Mitsui Chemicals, Inc.; a one-liquid type epoxy resin that yields Rockwell hardness of M80 when cured). The solution thus obtained was used for spray coating the entire surface of the magnet test piece by operating an air spray apparatus equipped with a gun 1.5 mm in aperture diameter at a blowing pressure of 0.2 MPa. Thus, by drying at an ordinary temperature (20° C.) for 60 minutes and baking at 200° C. for 30 minutes, a conductive coating (having a volume resistivity of $5\times10^{-1}$ Ω·cm as measured in accordance with JIS-H0505 standard method) containing 96 wt % of dispersed zinc powder was formed at a film thickness of 15 μm (as measured by observation of cross section) on the surface of the magnet test piece. Salt water spray test was conducted by spraying 5 wt % salt water at 35° C. on the thus obtained magnet test piece having thereon the conductive coating made of the resin containing the zinc powder dispersed therein. After a lapse of 500 hours, rust generated on two magnet test pieces (n=50).

Example 2

By using the same non-conductive resin solution containing dispersed therein a zinc powder as in Example 1, and by performing the same processes as in Example 1, there were obtained magnet test pieces having a non-conductive coating made of the resin containing the zinc powder dispersed therein and having subjected to barrel polishing. After performing ultrasonic rinsing with water for 3 minutes on the barrel-polished magnet test pieces having the non-conductive coating formed thereon, the magnet test pieces were immersed in the same Watt's bath as that used in Example 1. Example 2 differs from Example 1 in that a Ni electroplating process was performed for 120 minutes under a current density of 1.5 A/dm$^2$ by applying voltage from the initial stage of immersion. Thus, a Ni electroplating film was formed on the outermost surface of the magnet test pieces.

The magnet test pieces having a Ni electroplating film on the outermost surface thus obtained were subjected to ultrasonic rinsing with water for 3 minutes, and were dried at 100° C. for 60 minutes.

On observing the outer appearance of the Ni electroplating film formed on the outermost surface of the 20 magnet test pieces with a magnifying glass (at 4 times magnification), no defective products having pinholes, protrusions, adhesion of foreign matter, and the like were found, and all of them were evaluated to be fine products having uniform coating. The average (n=5) total thickness of the Ni plating film formed on the surface of the non-conductive coating was found to be 25 μm (by observation using fluorescent X-ray spectroscopy). Although the film thickness of the Ni substituted plating film formed on the surface of the non-conductive coating is unmeasurable, the fact that such fine quality Ni electroplating films are formed on the outermost surface suggests that a Ni substituted plating film is formed on the lower layer, and that electric conductivity is imparted to the entire surface.

A corrosion resistance test was performed on 15 magnet test pieces having a Ni electroplating film formed on the outermost surface thereof, by allowing them to stand still under high temperature and high humidity conditions of 60° C. and 90% relative humidity for 500 hours. As a result, no abnormal appearance such as generation of rust, bulging of film, generation of local protrusion, and the like was observed on any of the magnet test pieces.

Comparative Example 2:

ELESHUT No.10 EMC (trade name of a commercially available product of Ohashi Chemical Industries Ltd.; yields Rockwell hardness of M80 when cured, and is based on acrylic resin with a nickel powder having an average particle diameter of 5 μm) was used as a conductive resin containing dispersed therein a nickel powder, and was diluted with a thinner for synthetic resin paints, i.e., No.5600 (trade name of a commercially available product of Ohashi Chemical Industries Ltd.) at a weight ratio of 1:0.5 (ELESHUT:thinner). By uniformly stirring the resulting product, there was obtained a conductive resin solution containing dispersed therein a nickel powder. The solution thus obtained was used for spray coating the entire surface of the magnet test piece by operating an-air spray apparatus equipped with a gun 1.5 mm in aperture diameter at a blowing pressure of 0.2 MPa. Thus, by drying at an ordinary temperature (20° C.) for 60 minutes and baking at 200° C. for 30 minutes, a conductive coating (having a volume resistivity of $2\times10^{-1}$ Ω·cm as measured in accordance with JIS-H0505 standard method) containing 66 wt % of dispersed nickel powder was formed at a film thickness of 15 μm (as measured by observation of cross section) on the surface of the magnet test piece.

By performing the same processes as in Example 1, there were obtained magnet test pieces having a conductive coating made of the resin containing the nickel powder dispersed therein and having subjected to barrel polishing. After performing ultrasonic rinsing with water for 3 minutes on the barrel-polished magnet test pieces having the conductive coating formed thereon, the magnet test pieces were immersed in the same Watt's bath as that used in Example 1. A Ni electroplating process was performed for 120 minutes under a current density of 1.5 A/dm$^2$ by applying voltage from the initial stage of immersion. Thus, a Ni electroplating film was formed on the outermost surface of the magnet test pieces.

The magnet test pieces having a Ni electroplating film on the outermost surface thus obtained were subjected to ultrasonic rinsing with water for 3 minutes, and were dried at 100° C. for 60 minutes.

On observing the outer appearance of the Ni electroplating film formed on the outermost surface of the 20 magnet test pieces with a magnifying glass (at 4 times magnification), at least one of pinholes, protrusions, and adhesion of foreign matter were found together with the formation of a non-uniform plating on all of the magnet test pieces, and all of them were evaluated to be defective products. The average (n=5) total thickness of the Ni plating film formed on the surface of the conductive coating was found to be 25 μm (by observation using fluorescent X-ray spectroscopy). The results above suggest that in Comparative Example 2, sufficient electric conductivity was not imparted for the formation of high quality Ni electroplating films, because no Ni substituted plating film was formed at the lower layer of the Ni electroplating film.

A corrosion resistance test was performed on 15 magnet test pieces having a Ni electroplating film formed on the outermost surface thereof, by allowing them to stand still under high temperature and high humidity conditions of 60° C. and 90% relative humidity for 500 hours. As a result, abnormal appearances such as generation of rust, bulging of film, generation of local protrusion, and the like were observed on all of the magnet test pieces.

Example 3

ELESHUT No.10 EMC (trade name of a commercially available product of Ohashi Chemical Industries Ltd.; yields Rockwell hardness of M80 when cured, and is based on acrylic resin with a nickel powder having an average particle diameter of 5 μm) was used as a conductive resin containing dispersed therein a nickel powder, and, together with SUNCOAT No. 503 (trade name of a commercially available product of Nagashima Special Paint Co., Ltd.; yields Rockwell hardness of M80 when cured and is based on epoxy resin), it was diluted with a thinner for synthetic resin paints, i.e., No.5600 (trade name of a commercially available product of Ohashi Chemical Industries Ltd.) at a weight ratio of 1:0.2:0.5 (ELESHUT:SUNCOAT:thinner), to obtain a mixed resin yielding Rockwell hardness of M80 when cured. After adding 0.5 wt % of DISPARLON #2150 (trade name of a commercially available anionic dispersant produced by Kusumoto Chemicals, Ltd.) and uniformly stirring the resulting mixture, there was obtained a non-conductive resin solution containing dispersed therein a nickel powder. The solution thus obtained was used for spray coating the entire surface of the magnet test piece by operating an air spray apparatus equipped with a gun 1.5 mm in aperture diameter at a blowing pressure of 0.2 MPa. Thus, by drying at an ordinary temperature (20° C.) for 60 minutes and baking at 200° C. for 30 minutes, a non-conductive coating (having a volume resistivity of $4\times10^{4}$ Ω·cm as measured in accordance with JIS-H0505 standard method) containing 55 wt % of dispersed nickel powder was formed at a film thickness of 15 μm (as measured by observation of cross section) on the surface of the magnet test piece.

By performing the same processes as in Example 1, there were obtained magnet test pieces having a non-conductive coating made of the resin containing the nickel powder dispersed therein and having subjected to barrel polishing. After performing ultrasonic rinsing with water for 3 minutes on the barrel-polished magnet test pieces having the non-conductive coating formed thereon, the magnet test pieces were immersed at 40° C. for 30 minutes without applying voltage in a Cu plating bath containing 25 g/L of copper sulfate pentahydrate, 55 g/L of disodium ethylenediamine tetraacetate, 28.2 g/L of sodium tartarate dihydrate, 71 g/L of sodium sulfate, and 25.2 g/L of sodium sulfite, with pH being adjusted to 6.8 by using sodium hydroxide, to thereby form a Cu substituted plating film on the surface of the non-conductive coating. At this instance, out of 25 magnet test pieces were drawn out of Cu plating bath to study the film thickness of the thus formed Cu substituted plating film. The average film thickness was found to be 2 μm (by observation using fluorescent X-ray spectroscopy).

The rest of the magnet test pieces (20 pieces) were subjected to a Cu electroplating process by applying voltage at a current density of 1.5 A/dm$^2$ for 90 minutes to form a Cu electroplating film on the surface of the Cu substituted plating film.

The magnet test pieces having a Cu electroplating film on the outermost surface thus obtained were subjected to ultrasonic rinsing with water for 3 minutes, and were dried at 100° C. for 60 minutes.

On observing the outer appearance of the Cu electroplating film formed on the outermost surface of the 20 magnet test pieces with a magnifying glass (at 4 times magnification), no defective products having pinholes, protrusions, adhesion of foreign matter, and the like were found, and all of them were evaluated to be fine products having uniform coating. The average (n=5) total thickness of the Cu plating film formed on the surface of the non-conductive coating was found to be 24 μm (by observation using fluorescent X-ray spectroscopy); hence, the average (n=5) film thickness of the Cu electroplating film was found to be 22 μm.

A corrosion resistance test was performed on 15 magnet test pieces having a Cu electroplating film formed on the outermost surface therein, by allowing them to stand still under high temperature and high humidity conditions of 60° C. and 90% relative humidity for 500 hours. As a result, no abnormal appearance such as generation of rust, bulging of film, generation of local protrusion, and the like was observed on any of the magnet test pieces, although slight coloring to brown was observed.

Example 4

Barrel-polished magnet test pieces having the non-conductive coating formed thereon were prepared by performing the same processes as in Example 1, and after performing ultrasonic rinsing with water for 3 minutes, the magnet test pieces were immersed at 50° C. for 30 minutes without applying voltage in a low-nickel high-sulfate bath containing 133 g/L of nickel sulfate pentahydrate, 213 g/L of sodium sulfate, 13 g/L of ammonium chloride, and 18 g/L of boric acid, with pH being adjusted to 5.8 by using sodium hydroxide, to thereby form a Ni substituted plating film 1 μm in film thickness (by observation using fluorescent X-ray spectroscopy) on the surface of the non-conductive coating. Then, a Ni electroplating process was performed for 90 minutes under a current density of 1.5 A/dm$^2$ by applying voltage to form a Ni electroplating film 24 μm in film thickness on the surface of the Ni substituted plating film (by observation using fluorescent X-ray spectroscopy).

The magnet test pieces having a Ni electroplating film on the outermost surface thus obtained were subjected to ultrasonic rinsing with water for 3 minutes, and were dried at 100° C. for 60 minutes. On observing the outer appearance of the Ni electroplating film formed on the outermost surface of the magnet test pieces with a magnifying glass (at 4 times magnification), no abnormal appearance such as pinholes, protrusions, adhesion of foreign matter, and the like was found. Furthermore, a corrosion resistance test was performed on the magnet test pieces having a Ni electroplating film formed on the outermost surface thereof, by allowing them to stand still under high temperature and high humidity conditions of 60° C. and 90% relative humidity for 500 hours. As a result, no abnormal appearance such as generation of rust, bulging of film, generation of local protrusion, and the like was observed on any of the magnet test pieces. Furthermore, a thermal shock test was performed on the magnet test pieces having a Ni electroplating film formed on the outermost surface thereof, by placing them still on a hot plate at 120° C. for 3 minutes. As a result, no abnormal appearance attributed to defective adhesion of the Ni substituted plating film to the non-conductive coating was observed.

Example 5

EPO ROVAL (trade name of a commercially available product of ROVAL Corporation; yields Rockwell hardness of M80 when cured, and is based on epoxy resin with a zinc powder having an average particle diameter of 4 μm) was used as a non-conductive resin containing dispersed therein a zinc powder, and, together with BANI (trade name of a commercially available product of Maruzen Petrochemical Co., Ltd.; a polyimide resin yielding Rockwell hardness of M128 when cured), it was diluted with EPO Thinner (trade name of a commercially available product of ROVAL Corporation) at a weight ratio of 1:0.2:0.5 (EPO ROVAL:BANI:thinner), to obtain a mixed resin yielding Rockwell hardness of M90 when cured. By uniformly stirring the resulting mixture, there was obtained a non-conductive resin solution containing dispersed therein a zinc powder. The solution thus obtained was used for spray coating the entire surface of the magnet test piece by operating an air spray apparatus equipped with a gun 1.5 mm in aperture diameter at a blowing pressure of 0.2 MPa. Thus, by drying at an ordinary temperature (20° C.) for 60 minutes and baking at 200° C. for 30 minutes, a non-conductive coating (having a volume resistivity of 2×106 Ω·cm as measured in accordance with JIS-H0505 standard method) containing 77 wt % of dispersed zinc powder was formed at a film thickness of 10 μm (as measured by observation of cross section) on the surface of the magnet test piece.

The magnet test pieces having a non-conductive coating made of the resin containing the zinc powder dispersed therein were subjected to barrel polishing in the same manner as in Example 1. After performing ultrasonic rinsing with water for 3 minutes on the barrel-polished magnet test pieces having the non-conductive coating formed thereon, a Ni substituted plating film 1 μm in film thickness was formed on the surface of the non-conductive coating, and a Ni electroplating film 24 μm in film thickness was further formed on the surface of the Ni substituted plating film by performing the same processes as in Example 1 (by observation using fluorescent X-ray spectroscopy).

The magnet test pieces having a Ni electroplating film on the outermost surface thus obtained were subjected to ultrasonic rinsing with water for 3 minutes, and were dried at 100° C. for 60 minutes. On observing the outer appearance of the Ni electroplating film formed on the outermost surface of the magnet test pieces with a magnifying glass (at 4 times magnification), no abnormal appearance such as pinholes, protrusions, adhesion of foreign matter, and the like was found. Furthermore, a corrosion resistance test was performed on the magnet test pieces having a Ni electroplating film formed on the outermost surface thereof, by allowing them to stand still under high temperature and high humidity conditions of 60° C. and 90% relative humidity for 500 hours. As a result, no abnormal appearance such as generation of rust, bulging of film, generation of local protrusion, and the like was observed on any of the magnet test pieces. Furthermore, a thermal shock test was performed on the magnet test pieces having a Ni electroplating film formed on the outermost surface thereof, by placing them still on a hot plate at 120° C. for 3 minutes. As a result, no abnormal appearance attributed to defective adhesion of the Ni substituted plating film to the non-conductive coating was observed.

Further, as a gasoline durability test, a test as follows was performed on the thus obtained magnet test pieces (denoted hereinafter as "samples") having a Ni electroplating film formed on the outermost surface thereof. Three samples were placed together with 12 mL of commercially available regular gasoline inside pressure-resistant airtight container having an inner volume of 50 mL, and the lid of the container was securely shut. Then, the pressure-resistant airtight container was enclosed in a water bath (thermostatic water bath), and after holding at 80° C. for 2 hours (the inner pressure of the container raises to about 300 kPa by the vapor pressure of gasoline), the pressure-resistant air tight container was taken out of the water bath to hold in the atmosphere for 12 hours. This sequential operation makes one cycle, and samples subjected to 5, 15, 30, and 50 cycles of this operation were prepared to study changes occurring on the dimension (outer diameter, inner diameter, and height), weight, ring pressure strength (load was applied vertical to the center line of the ring, and the load at rupture was measured). As a result, no particular changes were observed on any of the samples for any of the evaluation items even after repeating the operation for 50 cycles, showing excellent durability of the samples against gasoline. Although slight degradation was observed on the magnetic properties, it was of no practical problem. Further, in case a gasoline durability test was performed on the magnet test piece itself, a considerable increase in dimension was observed on the magnet test piece due to the swelling of the resin binder by gasoline.

Example 6

Barrel-polished magnet test pieces having the non-conductive coating formed thereon were prepared by performing the same processes as in Example 5, and after performing ultrasonic rinsing with water for 3 minutes, the same processes as in Example 4 were performed to form a Ni substituted plating film 1 μm in film thickness on the surface of the non-conductive coating and further a Ni electroplating film 24 μm in film thickness on the surface of the Ni substituted plating film (by observation using fluorescent X-ray spectroscopy).

The magnet test pieces having a Ni electroplating film on the outermost surface thus obtained were subjected to ultrasonic rinsing with water for 3 minutes, and were dried at 100° C. for 60 minutes. On observing the outer appearance of the Ni electroplating film formed on the outermost surface of the magnet test pieces with a magnifying glass (at 4 times magnification), no abnormal appearance such as pinholes, protrusions, adhesion of foreign matter, and the like was found. Furthermore, a corrosion resistance test was performed on the magnet test pieces having a Ni electroplating film formed on the outermost surface thereof, by allowing them to stand still under high temperature and high humidity conditions of 60° C. and 90% relative humidity for 500 hours. As a result, no abnormal appearance such as generation of rust, bulging of film, generation of local protrusion, and the like was observed on any of the magnet test pieces. Furthermore, a thermal shock test was performed on the magnet test pieces having a Ni electroplating film formed on the outermost surface thereof, by placing them still on a hot plate at 120° C. for 3 minutes. As a result, no abnormal appearance attributed to defective adhesion of the Ni substituted plating film to the non-conductive coating was observed.

Experiment B (Formation of an Electroplating Film on the Surface of a Transparent Acrylic Sheet)

Five transparent acrylic sheets each 60 mm in length, 20 mm in width, and 2 mm in thickness were set inside a compact vibration barrel (VM-10, manufactured by Tipton Corp.) together with 2 L of alumina media (PSϕ4, manufactured by Tipton Corp.), and a surface polishing of the transparent acrylic sheets was performed for 30 minutes. Then, the transparent acrylic sheets subjected to the surface polishing were immersed in acetone for 1 minute for surface degreasing, and were allowed to dry naturally.

EPO ROVAL (trade name of a commercially available product of ROVAL Corporation; contains a zinc powder having an average particle diameter of 4 μm) was used as a non-conductive resin containing dispersed therein a zinc powder, and was diluted with EPO Thinner (trade name of a commercially available product of ROVAL Corporation) at a weight ratio of 1:0.7 (EPO ROVAL:thinner). By uniformly stirring the resulting product, there was obtained a non-conductive resin solution containing dispersed therein a zinc powder. The solution thus obtained was used for spray coating the entire surface of the transparent acrylic sheet by operating an air spray apparatus equipped with a gun 1.2 mm in aperture diameter at a blowing pressure of 0.2 MPa. Thus, by drying at an ordinary temperature (20° C.) for 60 minutes and baking at 200° C. for 30 minutes, a non-conductive coating (having a volume resistivity of $2\times10^5$ Ω·cm as measured in accordance with JIS-H0505 standard method) containing 96 wt % of dispersed zinc powder was formed at a film thickness of 15 μm (as measured by observation of cross section) on the surface of the transparent acrylic sheet.

Five transparent acrylic sheets having a non-conductive coating formed thereon as obtained in step 1 were set inside the compact vibration barrel (VM-10, manufactured by Tipton Corp.) together with 2 L of alumina media (PSϕ4, manufactured by Tipton Corp.), and a surface polishing of the non-conductive coating was performed for 30 minutes.

The transparent acrylic sheets having the non-conductive coating formed thereon and subjected to surface polishing were immersed at 55° C. for 30 minutes without applying voltage in Watt's bath containing 240 g/L of nickel sulfate pentahydrate, 45 g/L of nickel chloride pentahydrate, and 35 g/L of boric acid, with pH being adjusted to 4.2 by using basic nickel carbonate, to thereby form a Ni substituted plating film on the surface of the non-conductive coating. At this instance, 2 out of 5 transparent acrylic sheets were drawn out of Watt's bath to study the film thickness of the thus formed Ni substituted plating film. As a result, the Ni substituted plating film was found to have an average film thickness of 1 μm (as measured by observation of cross section). The thus formed Ni substituted plating film exhibited surface appearance as metallic Ni, and yielded a volume resistivity of $5\times10^{-6}$ Ω·cm. Accordingly, it was found that practically satisfactory products can be obtained at this stage so long as they are used for imparting decorative properties, surface conductivity for antistatic purposes, and the like.

The rest of the transparent acrylic sheets (3 sheets) were subjected to a Ni electroplating process by applying voltage at a current density of 1.5 A/dm$^2$ for 90 minutes to form a Ni electroplating film on the surface of the Ni substituted plating film.

The transparent acrylic sheets having a Ni electroplating film on the outermost surface thus obtained were subjected to ultrasonic rinsing with water for 3 minutes, and were dried at 100° C. for 60 minutes.

On observing the outer appearance of the Ni electroplating film formed on the outermost surface of the 3 transparent acrylic sheets with a magnifying glass (at 4 times magnification), no defective products having pinholes, protrusions, adhesion of foreign matter, and the like were found, and all of them were evaluated to be fine products having uniform coating. The average (n=3) total thickness of the Ni plating film formed on the surface of the non-conductive coating was found to be 25 μm (as measured by observation of cross section); hence, the average (n=3) film thickness of the Ni electroplating film was found to be 24 μm.

Experiment C (Formation of an Electroplating Film on the Surface of a Wooden Mascot Bat)

Similar to the case of Experiment B, a uniform and dense Ni electroplating film was formed with high adhesion strength on the surface of a wooden mascot bat 240 mm in length and about 10 mm in diameter.

Experiment D (Formation of an Electroplating Film on the Surface of a Corrugated Fiberboard)

Similar to the case of Experiment B (except for omitting the twice performed surface polishing steps using compact vibration barrel), a uniform and dense Ni electroplating film was formed with high adhesion strength on the surface of a corrugated fiberboard 60 mm in length, 20 mm in width, and 2 mm in thickness.

Experiment E (Formation of an Electroplating Film on the Surface of a Transparent Glass Sheet)

Similar to the case of Experiment B, a uniform and dense Ni electroplating film was formed with high adhesion strength on the surface of a transparent glass sheet 60 mm in length, 20 mm in width, and 2 mm in thickness.

Experiment F (Formation of an Electroplating Film on the Surface of an Aluminum Sheet)

Similar to the case of Experiment B, a uniform and dense Ni electroplating film was formed with high adhesion strength on the surface of an aluminum sheet 60 mm in length, 20 mm in width, and 2 mm in thickness.

Experiment G (Formation of an Electroplating Film on the Surface of a Magnesium Alloy Sheet)

Similar to the case of Experiment B, a uniform and dense Ni electroplating film was formed with high adhesion strength on the surface of a magnesium alloy sheet 60 mm in length, 20 mm in width, and 2 mm in thickness.

INDUSTRIAL APPLICABILITY

The present invention provides a method for forming a uniform and dense electroplating film with high adhesion strength on the surface of an article, yet irrespective of the surface material and the surface properties of the article.

The invention claimed is:

1. A method for forming an electroplating film on the surface of a rare earth permanent magnet, which comprises: forming on the surface of the magnet, a resin coating made of a resin containing dispersed therein a powder of a first metal; then forming a second-metal substituted plating film on the surface of the resin coating by immersing the resin-coated magnet in a solution containing ions of a second metal having an ionization potential nobler than that of the first metal; and further forming an electroplating film of a third metal on the surface of the metal-substituted plating film, wherein the resin coating is a non-conductive coating, the second metal and the third metal are the same, and the step of forming the substituted plating film and the step of forming the electroplating film are carried out in the same plating bath.

2. A method for forming an electroplating film as claimed in claim 1, wherein the rare earth permanent magnet is a bonded magnet.

3. A method for forming an electroplating film as claimed in claim 1, wherein the volume resistivity of the non-conductive coating is $1\times10^4$ Ω·cm or higher.

4. A method for forming an electroplating film as claimed in claim 1, wherein the powder of the first metal is dispersed in the resin coating at a content in a range of from 50 wt% to 99 wt%.

5. A method for forming an electroplating film as claimed in claim 1, wherein the average particle diameter of the powder of the first metal is in a range of from 0.001 μm to 30 μm.

6. A method for forming an electroplating film as claimed in claim 1, wherein the film thickness of the resin coating is in range of from 1 μm to 100 μm.

7. A method for forming an electroplating film as claimed in claim 1, wherein the first metal is zinc and the second metal is nickel or tin.

8. A method for forming an electroplating film as claimed in claim 1, wherein the first metal is nickel and the second metal is copper.

9. A method for forming an electroplating film as claimed in claim 1, wherein the film thickness of the substituted plating film is in a range of from 0.05 μm to 2 μm.

* * * * *